US005727438A

United States Patent [19]

Beale et al.

[11] Patent Number: 5,727,438

[45] Date of Patent: Mar. 17, 1998

[54] SLIP YARN BRAIDING MACHINE

[75] Inventors: David G. Beale; Royall Broughton; Robert P. Walker, all of Auburn; John T. Klein, Mobile, all of Ala.; Qiang Zhang, Baltimore, Md.; Arnold Daniel Vickers, Bessemer, Ala.

[73] Assignee: Auburn University, Auburn University, Ala.

[21] Appl. No.: 650,845

[22] Filed: May 20, 1996

[51] Int. Cl.[6] ..... D04C 3/32

[52] U.S. Cl. ..... 87/45; 87/16; 87/37; 87/38; 87/47; 87/48; 87/50; 87/55

[58] Field of Search ..... 87/14, 16, 17, 87/33, 37, 38, 39, 44, 45, 46, 47, 48, 50, 54, 55, 56

[56] References Cited

U.S. PATENT DOCUMENTS

| | | | |
|---|---|---|---|
| 887,259 | 5/1908 | Lundgren . | |
| 1,081,474 | 12/1913 | Wardwell | 87/46 |
| 1,465,554 | 8/1923 | Klein | 87/46 |
| 1,512,605 | 10/1924 | Klein | 87/44 |
| 1,583,543 | 5/1926 | Frederickson . | |
| 1,602,442 | 10/1926 | Miller | 87/46 |
| 1,610,054 | 12/1926 | Hopkinson | 87/44 |
| 1,615,587 | 1/1927 | Klein et al. | 87/44 |
| 1,725,450 | 8/1929 | Frederickson | 87/44 |
| 1,748,553 | 2/1930 | Hopkinson | 87/44 |
| 1,760,768 | 5/1930 | Murphy . | |
| 1,872,168 | 8/1932 | Nanfeldt . | |
| 2,464,899 | 3/1949 | Sokol | 87/48 |
| 2,696,836 | 12/1954 | Caldes | 139/13 |
| 3,640,176 | 2/1972 | Gaul | 87/33 |
| 4,729,278 | 3/1988 | Graeff et al. | 87/48 |
| 5,099,744 | 3/1992 | Hurst et al. | 87/45 |

*Primary Examiner*—William Stryjewski
*Attorney, Agent, or Firm*—Cort Flint; Henry S. Jaudon

[57] ABSTRACT

A fabric forming device including a stationary yarn supply and a rotating yarn supply, each delivering yarn to a common point along a vertical axis where they are interlaced. The stationary yarn supply includes a plurality of yarn carrying cones which are arranged along a common horizontal plane about the vertical axis. The rotating yarn supply includes a plurality of yarn spools mounted with a rotating plate about the vertical axis. A plurality of vertically moveable guide members which are adapted to engage with the yarns of the rotating yarn supply act to selectively alter the horizontal path along which the yarns travel. The guide members act to control the yarns of the rotating yarn supply to be selectively positioned to pass above or below the cones carrying the stationary yarns so that the yarns interlace in a desired manner.

34 Claims, 7 Drawing Sheets

SLIP YARN BRAIDING MACHINE

BACKGROUND OF THE INVENTION

The instant invention relates to fabric forming machines and more particularly fabric forming machines in which the fabric is formed of two sets of yarns, one being interlaced with the other.

The invention is intended to function to produce fabric of good quality at a high rate while being configured to function with low tolerances of machine precision.

There have been several efforts to produce quality braided fabric with high efficiency and low down time as evidenced by U.S. Pat. Nos. 887,259; 1,760,768; 2,464,899; 4,729,278; 5,099,744. These devices each disclose two yarn supplies which include fixedly mounted spools mounted for counter rotation about a fixed axis. As the yarn supplies rotate, yarns of one of the supplies is caused to pass over and under the yarns of the other supply. The yarns are diagonally disposed relative to the length of fabric formed, but are transverse each other. In each instance the yarns which pass over and under are moved several inches vertically of their normal path of travel in order to be passed on opposite sides of the other yarns. Great precision is required in order for the yarns to all be properly located at the same time.

Similar efforts have been made in circular weaving machines as shown in U.S. Pat. Nos. 1,583,543; 1,872,168, and 2,696,836. In these devices there are shown two yarn supplies which interlace with each other about a central axis to form a fabric. One of the yarn supplies is stationary while the other rotates about the central axis. Both yarn supplies are delivered from packages fixed to the machine frame. In each patent the rotating yarn travels along a single horizontal plane while the stationary yarn is caused to move vertically above and below the moving yarn packages to bring about interlacing. Again, the vertical movement required of the stationary yarn is several inches which causes the fabric forming motion to be slowed and which also causes frequent machine stoppage. Also, the precision of the movements is critical to insure that vertical moving yarns are not entangled with the rotating drive of the rotating yarn supplies.

Accordingly, it is an object of this invention to provide a fabric forming machine which is of simple construction, capable of high fabric forming speeds and operates with a minimum of down time.

Another object of the invention is a fabric forming machine which operates with a high tolerance for non-precise motions.

Another object of the invention is a fabric forming device which brings about yarn interlacing with a minimum of motion.

Another object of the invention is the provision of a carrier for a yarn supply in which the yarn is carried in an unfixed manner.

Another object of the invention is a fabric forming machine in which the vertically moveable yarn is also the rotating yarn while the stationary yarn remains along a single horizontal plane.

Another object of the invention is the creation of interlacing by slippage.

SUMMARY OF THE INVENTION

The invention is directed to a fabric forming device which operates with a stationary yarn supply which is interlaced with moving yarn supply. The moving yarn supply moves in a circular path and also along a plurality of horizontal planes as it passes above and below the stationary yarn supply. There are normally an equal number of yarns in each system although this could vary.

The fabric forming device comprises a frame which supports a stationary plate and a rotating plate. The stationary plate includes an upper and a lower member mounted in vertically spaced relationship. There is an opening formed about the central axis of the plurality of members. Yarn spools are arranged side by side about the central axis with the yarns coming from these spools passing through the opening and away from the frame. The spools are carried by the stationary plate between the upper and lower members in an unfixed manner.

The rotating plate is mounted on the frame with its axis of rotation arranged along the central axis. A second plurality of yarn spools are arranged side by side about the upper surface of and generally adjacent the circumference of the rotating plate, with their yarns passing also through the opening. A take-off, which is arranged in spaced relation with the stationary plate, receives the yarns from the first and second spools and carries the yarns away from the frame.

Yarn guides are arranged along the path of the yarns coming from the second spools. The guides are arranged intermediate the first and second spools.

A patterning mechanism controls the vertical position of the yarn guides and thereby the vertical position of the rotating yarns to cause them to pass over or under each of the first yarns. This action causes the first and second yarns to become interlaced as they pass toward the machine axis and through the opening away from the frame.

The stationary yarn spools are each carried in a cylindrical egg shaped housing each of which are in turn carried by a cradle mounted about the central axis of the stationary plate. The cradles carry the housing in an unfixed manner.

Each cradle comprises an upper support element and a lower support element. The opposed surfaces of the upper and lower support elements are formed with recesses configured to conform with opposed portions of the outer surface of the housing. The configuration of the recesses act to limit movement of the housings' in an axial direction while at the same time supporting them in an unfixed manner.

The cradles may be resiliently mounted with the stationary plate between the upper and lower members. Also there could be a plurality of air jets connected with an air supply formed in at least the lower of the cavities which could act to suspend or levitate the housings' between the upper and lower support elements. Another arrangement could utilize magnetic fields within the support elements which would levitate the housings' within the support elements.

Each housing has a wedge mounted on its outer surface to extend substantially horizontally outwardly from the cradle between the upper and lower members of the stationary plate. The wedge is operative to deflect the yarns from the rotating yarn supply to slip over or under the housing as they rotate about the frame. There are limiting elements carried by the first and second members. The limiting elements engage with the wedge to limit the rotational movement of the housing.

In a first arrangement, the yarn guides are mounted with the rotating disk while the patterning mechanism is stationary with the frame. Each yarn guide may include a pivotally mounted lever having a yarn eye. The patterning mechanism is adapted to engage selectively with the levers to position the eyes in an upper or lower position as they move about the axis. The position of each eye causes each yarn to pass over or under the stationary yarns. The patterning mechanism may comprise a plurality of cam members or solenoid members.

In a second arrangement, the yarn guides are mounted with the rotating plate in a stationary position along a single plane. The patterning mechanism may comprise a plate pivotally mounted adjacent each of the stationary yarns carrying housings. A control for the patterning mechanism is operative to move the plate between a first and second position which locates the rotating yarn between vertical positions. This control includes a solenoid mounted beneath the plate.

The stationary yarn carrier assembly includes a plurality of cylindrical housings. Each housing has an outer configuration which is substantially egg shaped. The interior of the housing includes a yarn mount, and opposed forward and rear openings. A wedge is secured with the outer surface of the housing perpendicularly of its longitudinal axis. The yarn mount is adapted to mount a yarn spool within the interior of the housing in position to allow yarn from the spool to be drawn out of the forward opening of the housing. There is a tension member associated with the yarn mount which acts to tension the yarn being drawn from the housing.

The housing is formed of a material having a low co-efficient of friction such as aluminum, stainless steel, molded plastic, ceramic, or ceramic coated metal or plastic. The outer circumference of the housing adjacent its forward opening tapers toward the opening at an angle sharper than the tapered circumference at the rear of the housing.

A yarn interlacing apparatus which includes a stationary yarn supply and a rotating yarn supply with the yarns from the supplies being delivered to a common point along a vertical axis where they are interlaced. The stationary yarn supply including a plurality of cones, each carrying a spool of yarn, which are arranged about the axis and along a common horizontal plane. The rotating yarn supply includes a plurality of yarn spools mounted with a rotating plate and delivering the rotating yarns to the central axis from a location outwardly of the cones carrying the stationary yarns. Vertically movable guide members are provided to engage with the rotating yarns to selectively alter their path of travel to the central axis in the vertical direction. The guide members cause the yarns of the rotating yarn supply to be selectively positioned to pass above or below the cones causing the rotating and stationary yarns to interlace in a desired manner.

The instant arrangement allows a minimum of controlled movement of the moving yarn relative to the individual supplies of the stationary yarns in order for interlacing to occur. The device also does not require extreme intricacy of movement of the moving yarns thus allowing the device to function with a minimum of malfunctions or down time.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
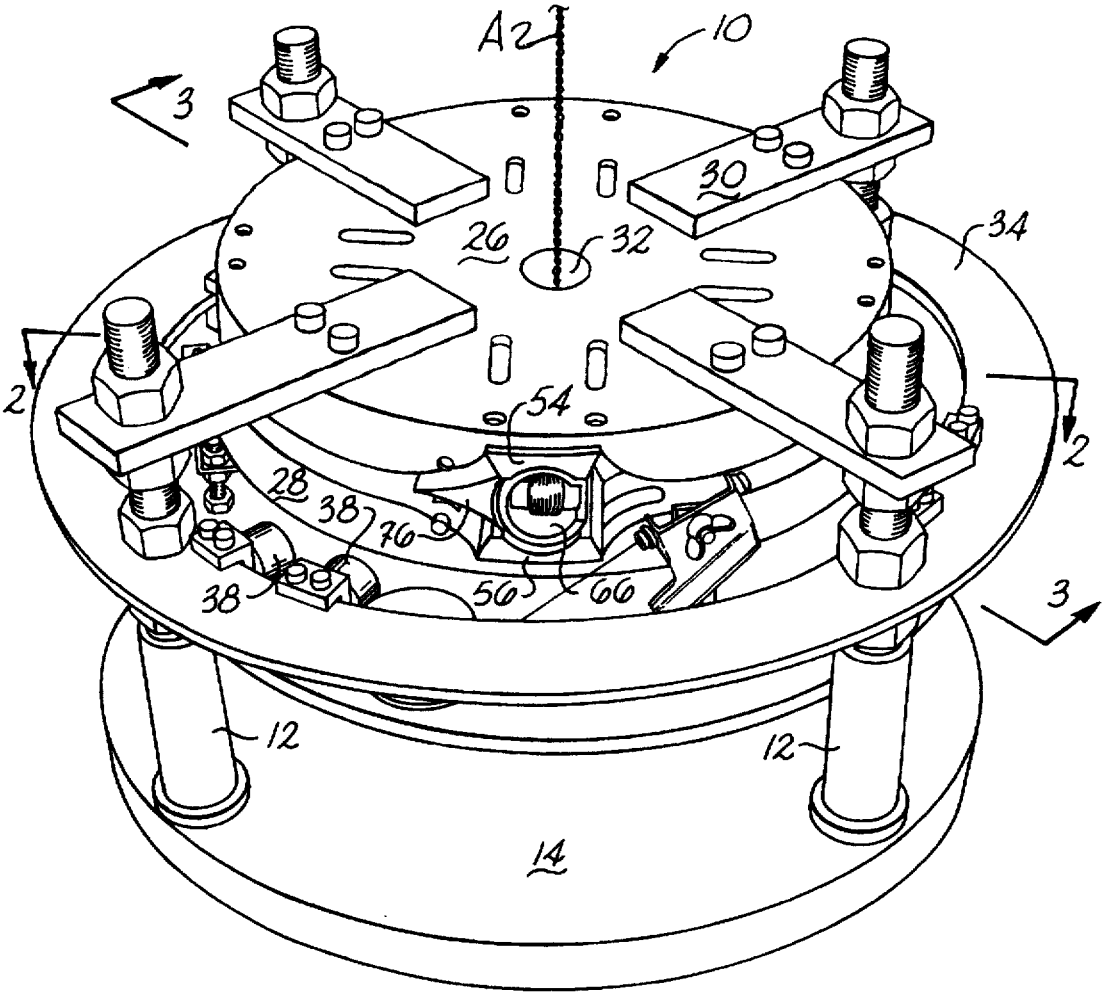
FIG. 1 is a perspective view of a first embodiment of the fabric forming device of the invention.
Figure 3:
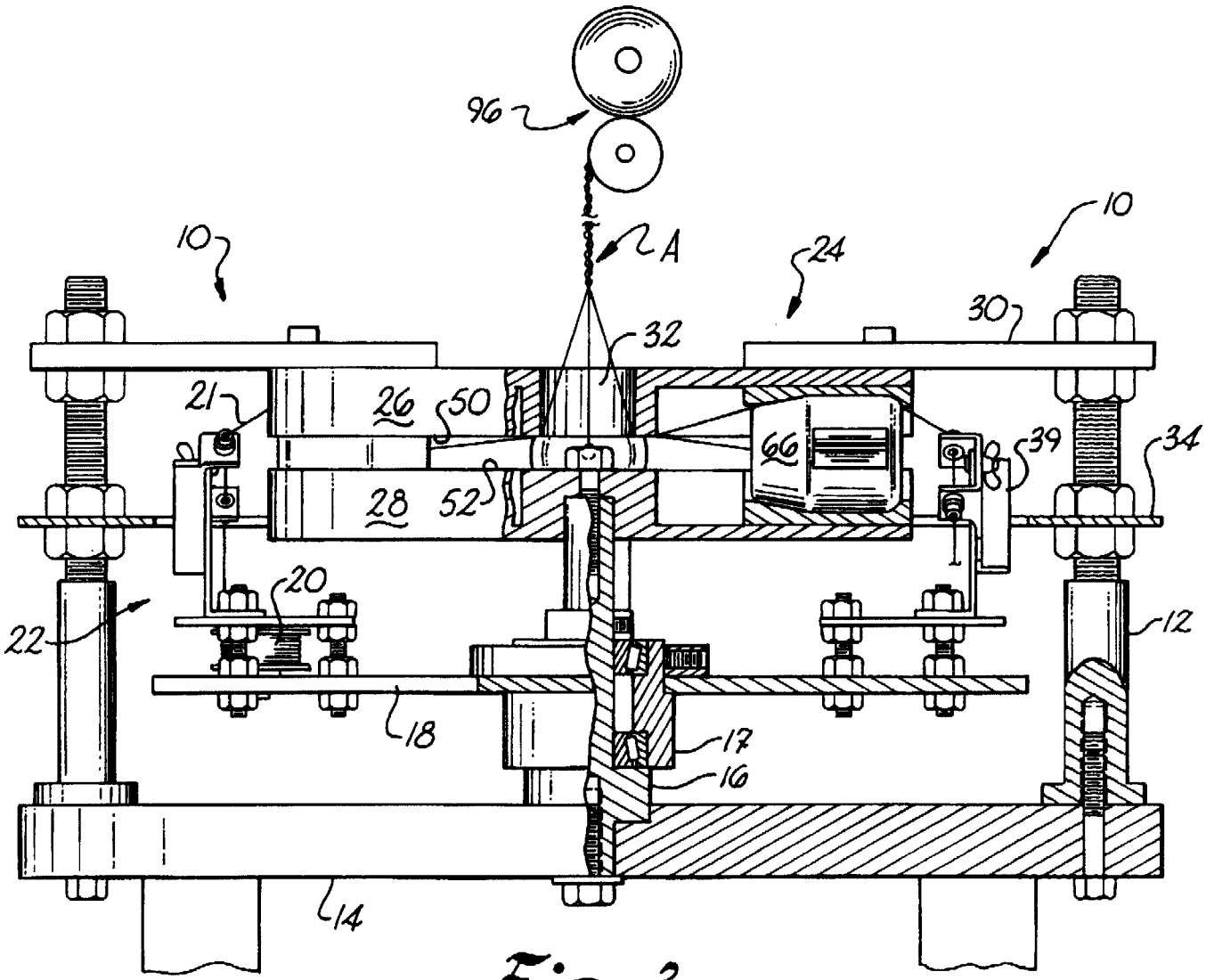
FIG. 3 is a side sectional view of the device shown in FIG. 1.

Turning now to the drawings, FIG. 1 is a perspective view of the fabric forming machine of the invention. Frame 10 includes a plurality of vertical post 12 which may be secured with a base 14 and are arranged to extend vertically and parallel with axis A. As shown in FIG. 3, a bushing 17 is rotably carried by shaft 16 at approximately its mid-point. Rotating plate 18 is secured with bushing 17 and is rotably driven by any conventional drive (not shown). Rotating plate 18, which could comprise a plurality of arms, is adapted to carry a plurality of yarn supply bobbins 20 and associated yarn guide members 22. The number of yarn supply bobbins carried by plate 18 varies depending upon the requirements of the product produced.

It is noted that shaft 16 could be formed hollow or with a central bore. This would allow a core to be fed through shaft 16 to be wrapped by the fabric being formed.

Arranged above rotating plate 18 and secured with post 12 is stationary plate 24. Stationary plate 24 includes super imposed upper and lower members or disk 26 and 28.

Upper disk 26 is supported atop post 12 by extensions 30 while lower disk 28 is secured atop shaft 16. Disk 26 and 28 are arranged with their central axis positioned along axis A. Upper disk 26 is formed with a central opening 32.

Post 12 also carries ring 34 which extends around frame 10 generally parallel with lower disk 28. Ring 34 is provided to add stability to frame 10 and also as a mount for the pattern mechanism, i.e. cams or solenoids.

Yarn supply bobbins 20 are carried by usual bobbin mounting devices which function to adequately tension the yarns being drawn off. Also, it is sometimes desirable to provide a yarn retraction device between spools 20 and eyes 44 or between eyes 42, 44 which would function to further assist in maintaining the rotating yarn under proper tension.

Figure 4:
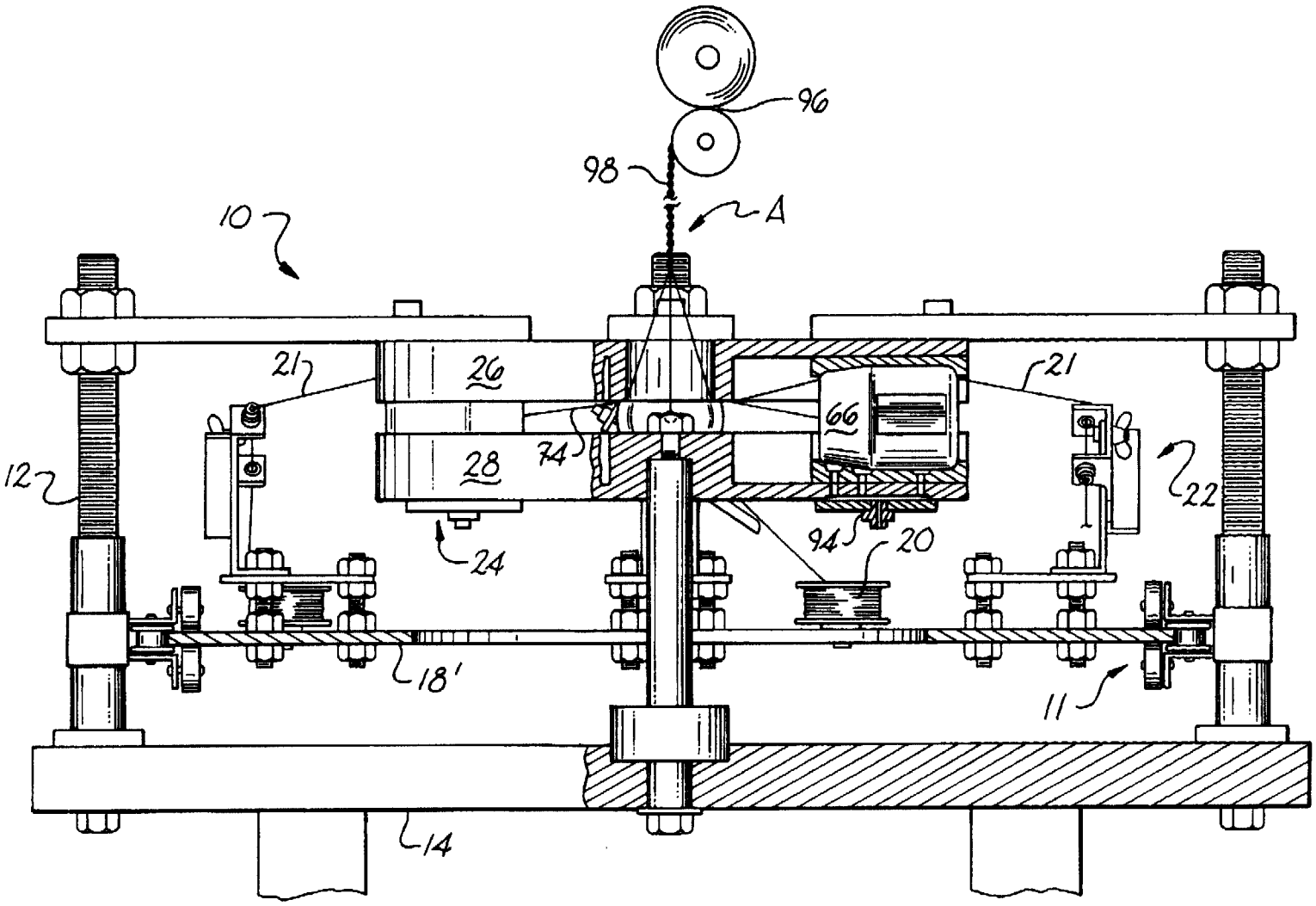
FIG. 4 is a side sectional view showing a second embodiment of the rotating plate of the apparatus of the invention.
Figure 5:
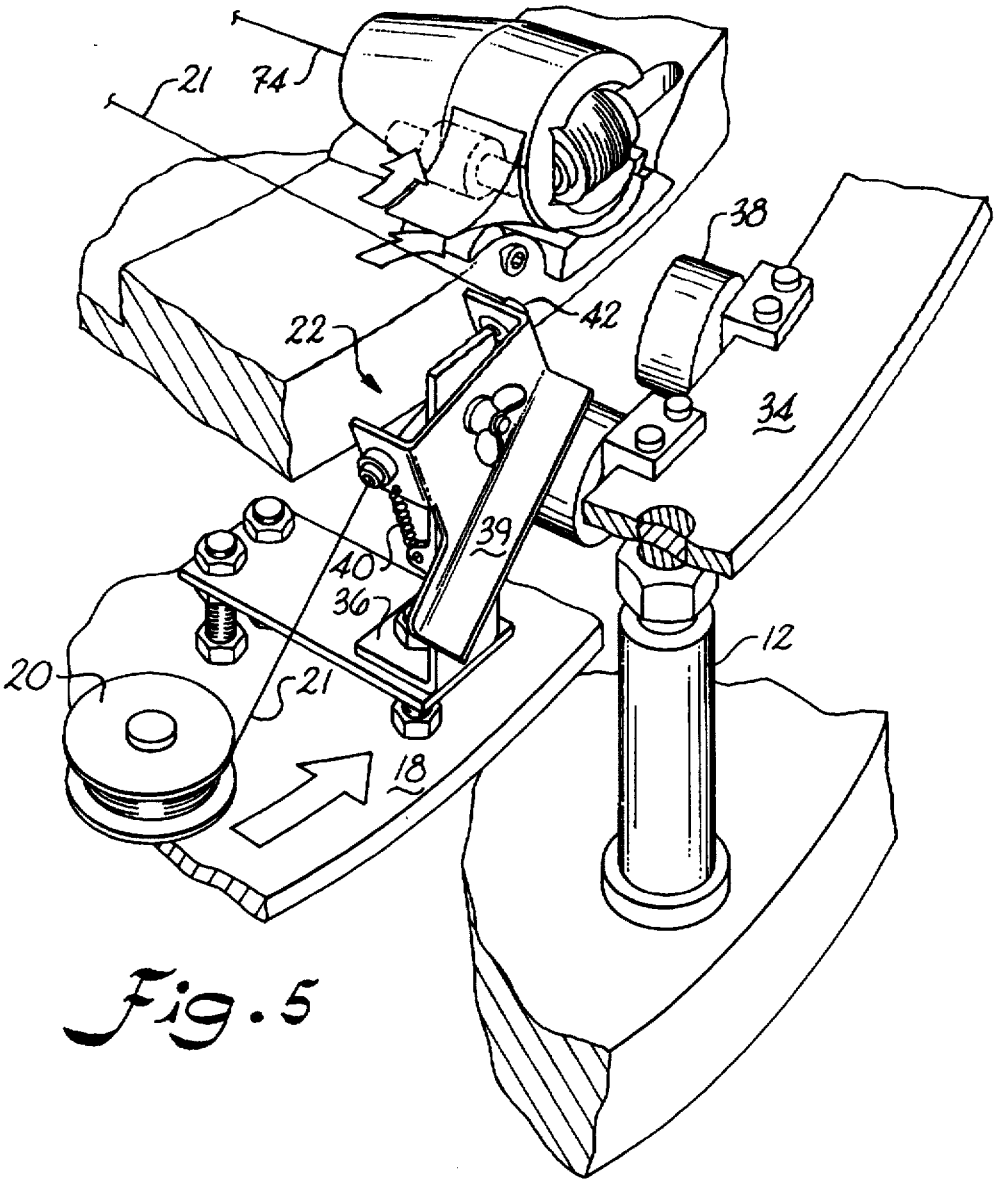
FIG. 5 is a perspective sectional detail view of the yarn guide and patterning device and the stationary yarn mounting structure of the first embodiment of the invention.
Figures 6A, 6B:
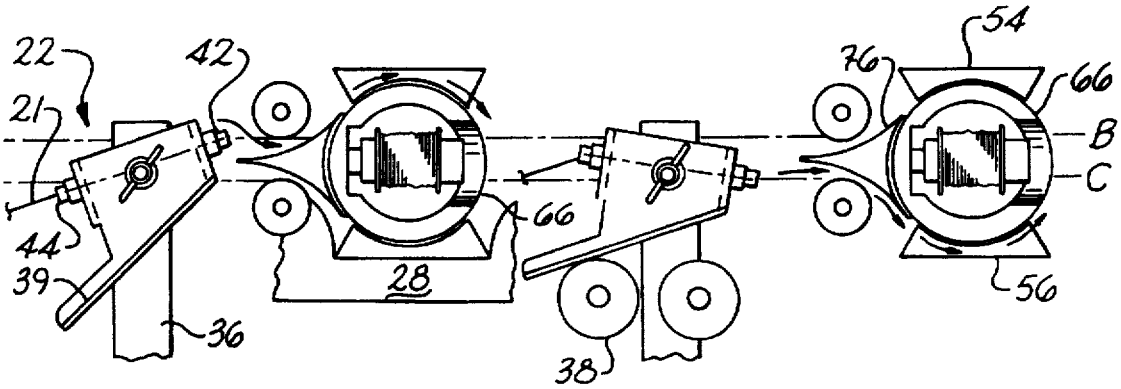
FIGS. 6A and 6B show the yarn guide as controlled by the patterning mechanism of FIG. 5.

An alternative construction of the rotating plate is shown in FIG. 4. In this arrangement lower disk 28 of stationary plate 24 is again carried by shaft 16 as shown in FIG. 3 and upper and lower disk 26, 28 are arranged parallel with their axis being located along central axis A. Rotating plate 18' is formed as a ring which is rotably supported at its outer edge by suitable bearing members 11 which are secured with post 12. Rotating plate 18' carries yarn supply spools 20 and yarn guides 22 as described and shown in FIGS. 3, 6, 7 or 10 and is driven by any conventional drive (not shown). By eliminating the center portion of rotating plate 18', a majority of its mass is eliminated. This allows a plate having a much larger circumference to be used.

Yarn guide 22, as shown in FIGS. 1, 2, 5, 6A and 6B, is a first embodiment of the yarn guide and patterning mechanism. Yarn guide 22, which is pivotally mounted on extension 36, includes a lever 39 having a cam surface and a pair of guide eyes 42, 44. Guide 22 normally maintains eye 42 positioned along an upper horizontal plane B and eye 44 positioned along horizontal plane C through the action of spring 40.

Extensions 36 are secured about the outer edge of rotating plate 18 with eyes 42 normally positioned slightly above the upper horizontal surface of lower disk 28. A spool 20 is mounted adjacent each guide 22 by any conventional mounting device and its yarn 21 is passed through eyes 44 or eyes 42 and 44, between disk 26 and 28 and through opening 32 out and away from frame 10.

Figure 2:
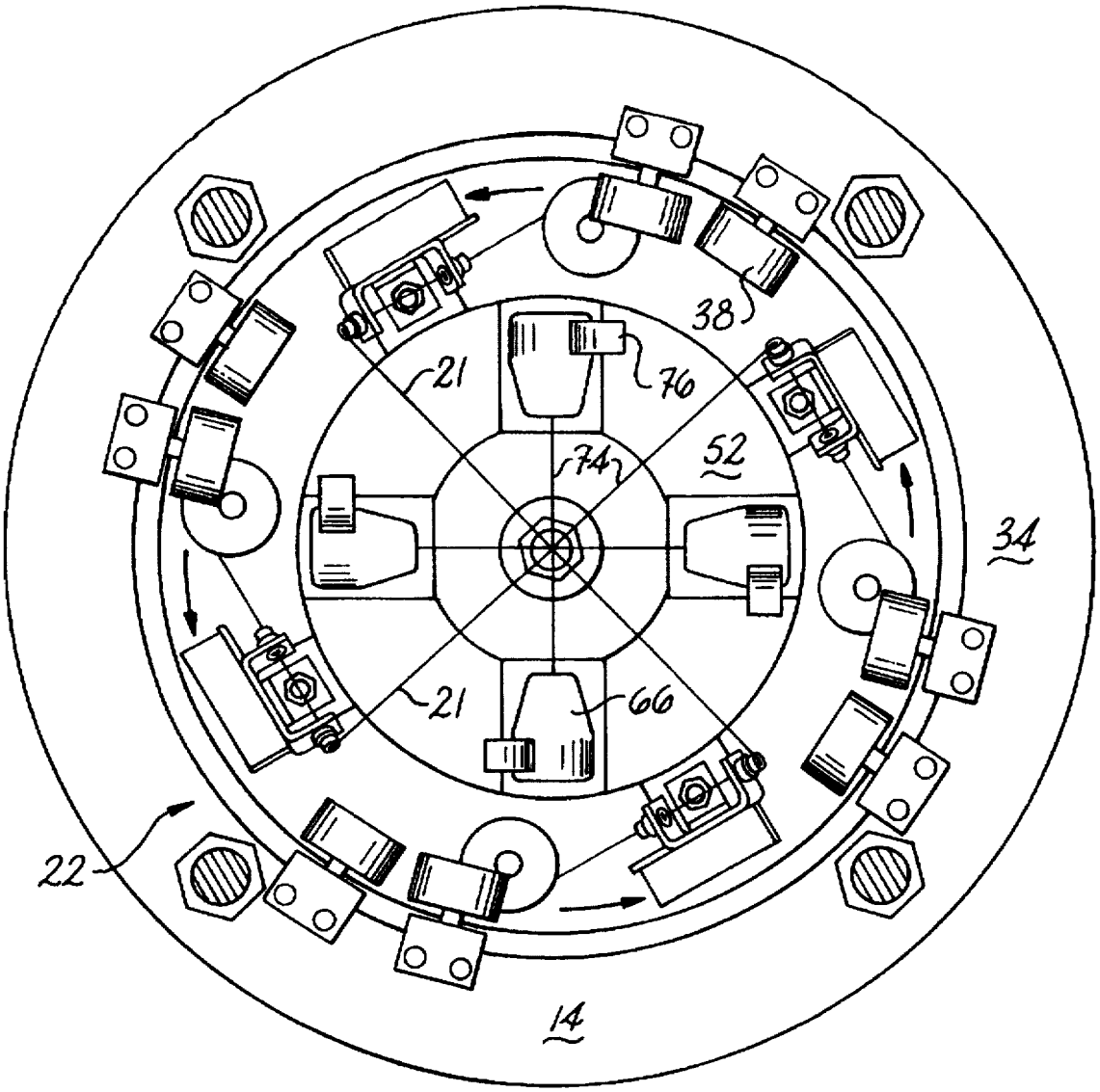
FIG. 2 is a top view of the device shown in FIG. 1 with the top disk omitted.

Cams 38 as shown in FIG. 2 are arranged about the inner circumference of ring 34, the number and location being dependent upon the desired pattern of the fabric being formed. Cams 38, when positioned to strike lever 39 of guide 22, act to pivot the lever so that eyes 42, 44 reverse positions along horizontal planes B and C. See FIGS. 6A and 6B.

In order to achieve a repetitive over and under interlacing action of yarns 21 with yarns 74, yarn guides 22 are threaded with alternate yarns 21 passing through eyes 44 and 42 and intermediate yarns 21 passing through only eyes 44. This locates the alternate yarns normally along plane B and the intermediate yarns normally along plane C during passage toward axis A.

Cams 38 are positioned as shown in FIG. 2, in selected spaced position about ring 34. In operation, cams 38 strike arms 39 each time a yarn guide 22 passes there beneath. Alternate yarns 21 which pass from eye 42 normally along plane B and over yarns 74 are temporarily moved to pass along plane C and beneath yarns 74 by the action of the cams. Likewise intermediate yarns which pass from eye 44 normally beneath yarns 74 along plane C are temporarily moved to pass along plane B and over yarns 74 by the action of cams 38. This arrangement produces the over, under interlacing relationship of yarns 21 with yarns 74.

Figure 7:
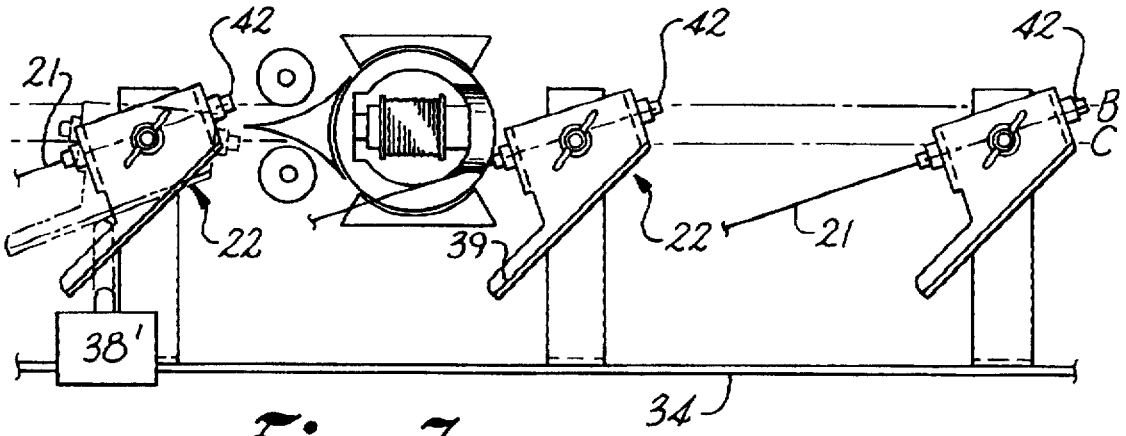
FIG. 7 is a sectional side view showing an alternate embodiment of the patterning device.

An alternative arrangement for the pattern device is shown in FIG. 7. In this embodiment, cams 38 are substituted for with solenoids 38'. Such an arrangement allows formation of fabrics having more intricate interlacing patterns without structurally altering the device. Solenoids 38', which may be controlled with a programmed computer, are simply actuated each time it is desired that yarn 21 be brought into another horizontal plane B or C so that it will pass over or under yarn 74 as desired.

Figure 10:
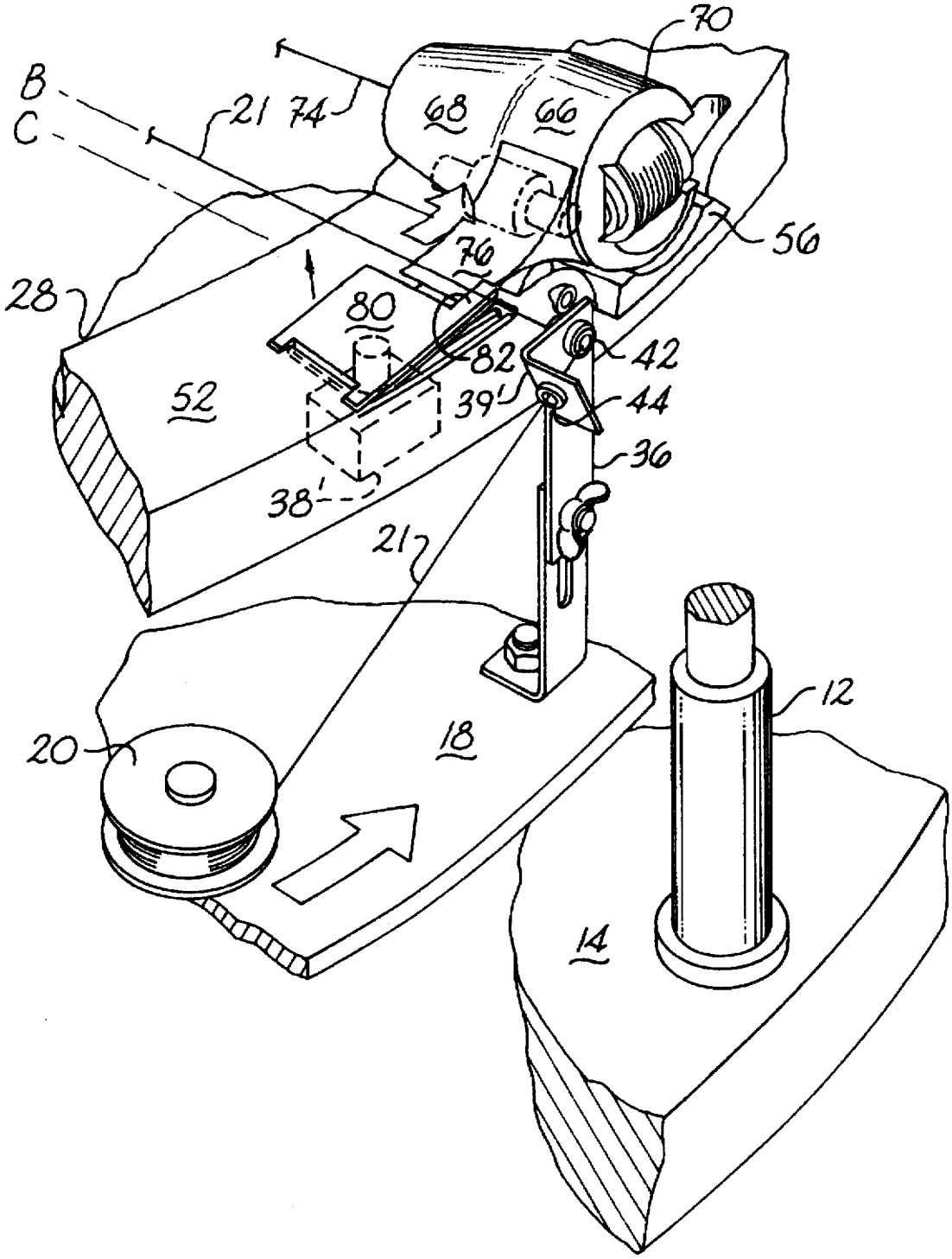
FIG. 10 is a perspective sectional view showing a second embodiment of the yarn guide patterning arrangement.

A third embodiment for delivery of the rotating yarn is shown in FIG. 10. Here yarn supply 20 is again carried by rotating plate 18. Guide eyes 44, 42 are carried by lever 39' which is secured with extension 36 in a fixed position. Yarn 21 passes through eye 44 and out eye 42 along lower horizontal plane C above lower disk 28.

Plate 80 is pivotally mounted with lower disk 28 to be flush with face 52. Plate 80 is arranged adjacent to the forward edge of wedge 76. Finger 82 of plate 80 is arranged to extend just beyond the forward edge to lie along the side of wedge 76. Plate 80 lies below the path traveled by yarn 21.

The patterning mechanism in this arrangement again involves solenoids 38' which may be controlled by a programmed computer. When activated, the solenoid engages and pivots plate 80 to an upper position. Plate 80 engages and elevates the engaged portion of yarn 21 to a position along the upper horizontal plane B. When elevated to upper plane B yarn 21 passes over yarn 74 and when left along plane C, yarn 21 passes beneath yarn 74.

Turning now to FIGS. 3, 5, 8 and 10, the structure of stationary plate 24 is described in more detail. As earlier set forth, stationary plate 24 comprises upper disk 26 and lower disk 28. The opposed inner faces of each disk, namely lower face 50 of the upper disk 26 and upper face 52 of the lower disk 28 have a plurality of super imposed shaped support elements 54, 56 arranged about and adjacent their outer edges. Support elements 54, 56 together form a cradle 62.

Figure 8:
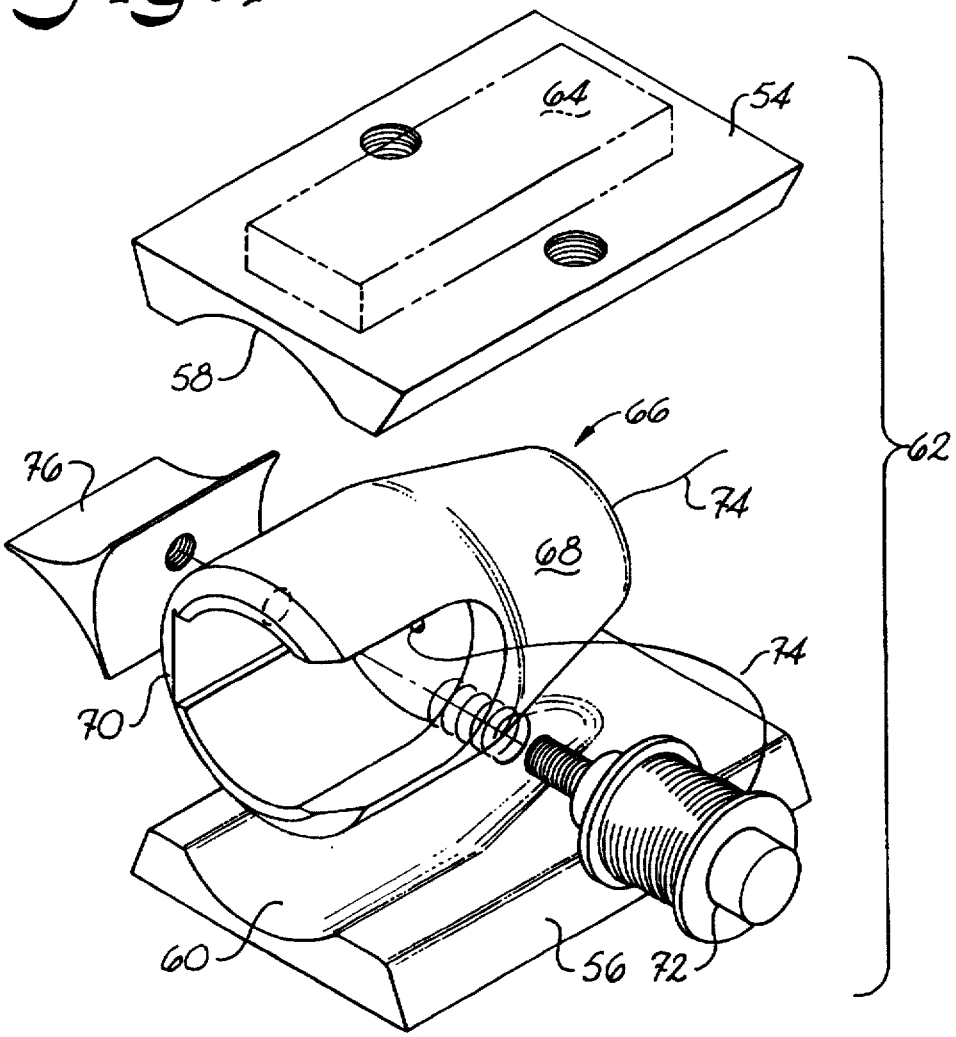
FIG. 8 is a detailed perspective view of a first embodiment of the stationary yarn carrying cone and cone carrying cradle arrangement.

The facing surfaces of support elements 54, 56 are formed with concave cavities 58, 60 as shown in FIG. 8. Support elements 54, 56 are attached to faces 50, 52 by any suitable means such as by screws. Preferably, there is a resilient member, such as the elastic pad 64 shown in FIG. 8, secured between support elements 54, 56 and faces 50, 52 to allow the plates a degree of flexibility.

A hollow egg shaped housing or cone 66 is configured to fit into cavities 58, 60 in such a manner as to be retained in position in an unfixed manner. Cone 66 has a cylindrical outer shape, having a tapered front end 68 and a tapered rear end 70. Cone 66 is formed with a hollow interior which is accessible through an opening in its front and rear ends 68, 70.

A yarn supply spool 72 is mounted within the interior of cone 66 by any known suitable mounting. The yarn 74 coming from spool 72 is led out the opening formed in forward end 68.

A wedge 76 is secured to the outer periphery of cone 66 in the vicinity of its center. Wedge 76 is arranged with its forward edge aligned along the longitudinal axis of the cone.

Wedge 76 and upper and lower faces 50, 52 act to limit rotational movement of cone 66. To further limit rotational movement of cone 66 and to smooth passage of yarn 21 over wedge 76, limiting rollers 26' and 28' may be attached to faces 50, 52. See FIGS. 6A and B.

Each station for the stationary yarn supply comprises upper and lower support element 54, 56 forming cradles 62. Cones 66 are matingly fitted into cavities 58, 60 with their forward ends facing axis A. The configuration of upper and lower recesses 58, 60 interact with tapered front portions 68 to maintain cones 66 in a fixed axial position while at the same time the cones are allowed floating movement relative to stationary plate 24. Cradles and cones 62, 66 are preferably formed with smooth outer surfaces having a low co-efficient of friction. They may be formed of polished metal such as steel or aluminum, of molded plastic of ceramic material or of a ceramic coated metal or plastic.

Figure 9:
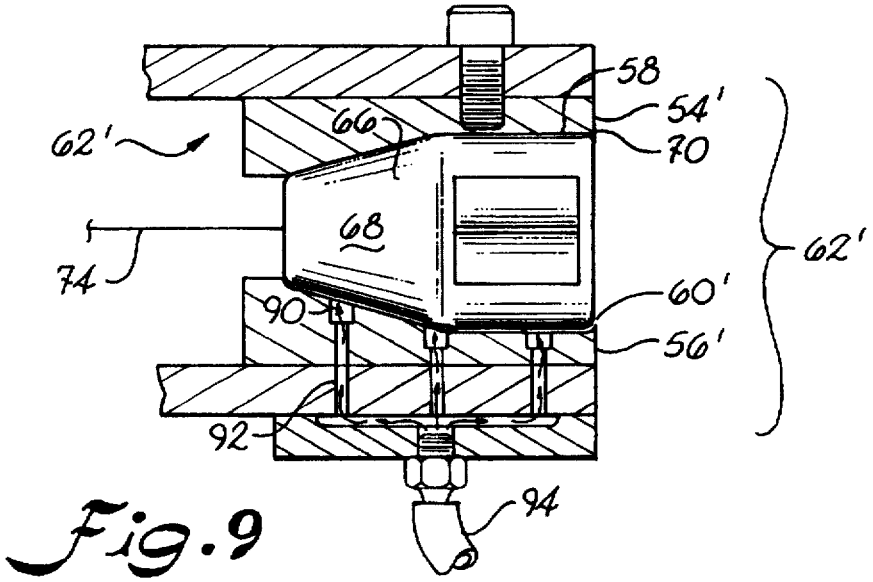
FIG. 9 is a sectional side view of a second embodiment of the cone carrying cradle arrangement.

A second embodiment for the cradle assembly is shown in FIGS. 4 and 9. In this arrangement, cone 66 is substantially as previously described. Cradle 62' includes forming support elements 54', 56' having cavities 58' and 60' which are essentially shaped as support elements 54, 56. Within each cavity 60' of lower plate 56' there are provided a plurality of nozzles 92 arranged along transverse troughs 90 formed across a major portion of the surface of cavity 60'. There are three rows of troughs 90 shown, however this number may be greater or less. Also, there may be only one or a plurality of nozzles 92 connected with each trough. Air, under pressure, is supplied through pipe 94. Alternatively, the troughs may be eliminated and the jets may expel air directly into the cavity. In any of these arrangements, cones 66 are maintained in a suspended condition or are levitated within the cavities of cradle 62' by means of an air cushion. The air supply arrangement described may also be incorporated into upper plate 54'.

In another alternative arrangement, magnetic fields could be provided within each cradle which would act to levitate or maintain the cones suspended.

In operation, stationary yarn is drawn from the supply cones 20 mounted on rotating disk 18, 18' as individual yarn strands 21. As yarn 21 emerges from guide 22, it passes along a horizontal plane B or C to central axis A where it passes from frame 10. As disk 18, 18' are rotated, yarns 21 are also rotated within frame 10.

Yarn 74 is also drawn from supply spools 72 which are carried in cones 66. Cones 66 are maintained substantially stationary by cradles 62, 62' which are carried by stationary plate 24. As yarn 74 passes from cone 66 it travels along a single substantially horizontal plane to axis A, through opening 32 and away from frame 10. During passage of yarns 21 and 74 away from their respective supplies yarns 21 are caused to move vertically so that they pass selectively over and under yarns 74 during their rotational motion about axis A.

In the embodiment shown in FIGS. 1—3, 6A and 6B, rotating plate 18 moves yarn 21 about axis A in the direction of the arrow (FIG. 2) and toward the forward edge of wedge 76. These yarns 21 travel normally along a selected of horizontal planes B and C. At selected points adjacent selected one of cones 66 cams 38 engage, which engage lever 39 and move selected yarns 21 to the desired plane B or C where it engages the lower or upper surface of wedge 76 to pass over or under cone 66. See FIG. 6B. At other points adjacent selected cones 66 there are no cams provided. This allows yarns 21 to remain in their normal position along plane B or C where they engage the upper or lower surface of wedge 76 and pass over or under cones 66 as desired.

In the instance where yarn 21 remains along plane B, and engages the upper surface of wedge 76 it slips up and over cone 66 causing it to pass over yarn 74. Where yarn 21 is lowered to plane C, and engages the lower side of wedge 76 it slips beneath cone 66 and passes below yarn 74.

The embodiments shown in FIGS. 7 and 10 function in a similar manner, the exception being that solenoids 38' act to move yarn 21 between planes B and C. Also, in the embodiment shown in FIG. 10 yarn guide eye 42 is maintained along lower plane C in which position the yarn passes beneath cones 66. When it is desired that yarn 21 be positioned to slip over a cone 66, lever 80 is raised to elevate that portion of yarn 21 adjacent to the edge of wedge 76 to be along plane B so that it engages the upper surface of the wedge.

By selectively arranging or activating the pattern devices 38, 38' any desired sequence of over and under between yarns 21 and 74 may be achieved. Because there is no physical obstruction through which the rotating yarn must pass such as gear teeth; and, because the distance which the rotating yarn is required to be deflected is minimal (as little as ¼"); and, because there are a minimum number of moving parts; the instant fabric forming device functions with great efficiency at high speeds.

It is noted that while FIG. 2 shows eggs 66 arranged at a 90° angle with center axis A, this orientation could be altered to have the eggs arranged to be closer to parallel with axis A.

While a preferred embodiment of the invention has been described using specific terms, such description is for illustrative purposes only, and it is to be understood that changes and variations may be made without departing from the spirit or scope of the following claims.

What is claimed is:

1. A fabric forming device comprising:

a frame supporting a stationary plate and a rotating plate;

said stationary plate including an upper member and a lower member mounted in vertically spaced relationship, said stationary plate having an opening formed through at least said upper member about its central axis;

a plurality of first yarn spools arranged radially outward from and circumferentially about said central axis with the yarns from said first spools passing through said opening, said first spools being carried by said stationary plate in an unfixed manner;

said rotating plate being mounted on said frame with its axis of rotation arranged along said central axis, a second plurality of yarn spools arranged circumferentially about said rotating plate and radially outward of said first spools so that the yarns of said second spools pass from outwardly of said first spools between said upper and lower members and through said opening;

a take-off arranged in spaced relation of said stationary plate receiving said yarns from said first and second spools, said take-off being operative to carry said yarns away from said plates;

a moveable yarn guide, arranged along the path of travel of each said yarn coming from said second spools, said movable yarn guides being and operative to selectively position the yarns of said second spools to pass over and under said yarns of said first spools;

a patterning mechanism, said patterning mechanism controlling the position of said yarn guides; whereby, in operation, said rotating plate rotably carries said second spools about said axis while said patterning mechanism controls said yarn guides to position said second yarns to pass over and under each of said first yarns causing said first and second yarns to be interlaced as they pass through said opening and away from said frame.

2. The device of claim 1 wherein said first yarn spools are each carried in a cylindrical egg shaped cone; and said stationary plate includes a plurality of cradles, said cradles being adapted to carry said cones in an unfixed manner.

3. The device of claim 2 wherein each said cradle comprises an upper support element and a lower support element, said upper support element having a lower surface having a recess configured to conform with a portion of the outer surface of said cone and said lower support element having an upper surfaced having a recess configured to conform with a portion of said outer surface of said cone;

pairs of said upper and lower support elements cradling each of said cones in an unfixed manner.

4. The device of claim 3 wherein said cradle is carried by said stationary plate.

5. The device of claim 3 wherein said cradle is resiliently mounted with said stationary plate between said upper and lower members.

6. The device of claim 3 wherein at least one of said upper and lower configured recesses include a plurality of air jets connected with an air supply, said jets acting to engage and suspend said cone between said upper and lower plates.

7. The device of claim 3 wherein said cone includes a wedge mounted on its outer surface, said wedge extending substantially horizontally outwardly from said cradle and between said upper and lower members, said wedge being operative to deflect said yarns from said second spools to slip over or under said cone.

8. The device of claim 7 wherein said upper and lower members carry limiting elements which engage with said wedge to limit the rotational movement of said cone.

9. The device of claim 1 wherein said yarn guides are secured with said rotating plate and said patterning mechanism is secured with said frame, each said yarn guide including a pivotally mounted lever having at least a yarn eye through which a second yarn coming from said second spools passes, said patterning mechanism being adapted to engage with said levers to temporarily position said eyes between upper and lower position as they move about said axis, the position of said eyes causing said second yarns to pass over and under respective of said first yarns.

10. The device of claim 9 wherein said patterning mechanism comprises one of cam members and solenoid members.

11. The device of claim 1 wherein said yarn guides include guide eyes mounted with said rotating plate in stationary positions along a single plane; and said patterning mechanism includes a plurality of pivotally mounted plates moveable between first and second positions, said plates being located adjacent each of said first yarn spools;

a solenoid arranged beneath said plates, said solenoids being operative to control the position of said plates between said first and second position.

12. The device of claim 11 wherein said first yarn spools are carried in egg shaped spherical cones;

said plates when moved to said first position guide said second yarn to slip over said cone and said first yarn spools and when in said second position guide said second yarn to slip below said cone and said first yarn spool.

13. A yarn carrier comprising:

a cylindrical housing, said housing having an outer configuration which is substantially egg shaped;

said housing having a hollow interior, which includes a yarn mount and opposed forward and rear openings;

a wedge secured with the outer surface of said housing; wherein, said yarn mount mounts a yarn carrying spool within said interior of said housing with said yarn of said spool extend through said forward opening to be drawn out of said housing.

14. The yarn carrier of claim 13 wherein said yarn mount includes a tension member, said tensioning member tensioning said yarn drawn from said housing.

15. The yarn carrier of claim 13 wherein said housing is formed of a material having a low coefficient of friction.

16. The yarn carrier of claim 15 wherein said material is one of aluminum, stainless steel, molded plastic, ceramic and ceramic coated metal.

17. The yarn carrier of claim 13 wherein the outer circumference of said housing adjacent said forward opening tapers toward said opening.

18. The yarn carrier of claim 13 wherein said yarn mount is arranged adjacent said rear opening.

19. The yarn carrier of claim 13 wherein the outer circumference of said housing adjacent said rear opening tapers toward said rear opening.

20. A fabric forming device including yarn interlacing apparatus, said apparatus including:

a stationary yarn supply and a rotating yarn supply, said yarns from said supplies being delivered to a common point along a vertical axis where they are interlaced;

said stationary yarn supply including a plurality of cones each carrying a spool of yarn, said cones being arranged radially outward of and about said axis;

said rotating yarn supply including a plurality of spools of yarn mounted with a rotating support member, said yarns of said rotating yarn supplies extending radially from said axis to a position beyond the radial position of said cones carrying said stationary yarn supplies;

vertically movable guide members adapted to engage with said yarns of said rotating yarn supply, said guide members being adapted to selectively and temporarily alter the horizontal path of said yarns of said rotating yarn supply in the vertical direction; whereby, said yarns of said rotating yarn supply are selectively caused to pass above and below said cones carrying said yarns of said stationary yarn supply causing said yarns of said yarn supplies to interlace in a desired manner.

21. The apparatus of claim 20 including a stationary plate comprising an upper and a lower member arranged about said axis, said stationary plate forming a plurality of cone supporting cradles between said upper and lower members and arranged about said axis.

22. The apparatus of claim 21 wherein each of said cones are egg shaped and said cradles include opposed cavities which are substantially mirror image of said cones and which receive at least a portion of the periphery thereof.

23. The apparatus of claim 22 wherein said cradles include means acting to levitate said cones within said cavities.

24. The apparatus of claim 23 wherein said levitating means is compressed air.

25. The apparatus of claim 20 wherein each of said cones mounts a wedge having a tip, said wedge being directed to receive the rotating yarns as they move about said axis and to guide them to slip over and under said cones causing said yarns to interlace.

26. The apparatus of claim 25 wherein said rotating yarns are in engagement with said cones during slipping.

27. The apparatus of claim 25 wherein said guide includes a plurality of pivotally mounted levers each having a yarn guide eye through which the rotating yarns pass, pattern members arranged to control said levers to vertically position said guide eyes and said rotating yarns to engage said wedge above or below said tip.

28. The apparatus of claim 20 wherein said guide members are positioned by one of cams and solenoids.

29. The apparatus of claim 20 wherein said guide members are mounted to rotate with said rotating yarns.

30. The apparatus of claim 20 wherein said guide members are mounted in a stationary position relative to said cones.

31. The apparatus of claim 20 wherein said guide members are controlled by a programmed computer.

32. Apparatus carrying a stationary yarn supply for use with a fabric forming device, said apparatus including:

a stationary plate comprising upper and lower vertically spaced members arranged about an axis a plurality of opposed indentures, formed in adjacent surfaces of said members, arranged about said axis, each pair of said opposed indentures forming a cradle;

a plurality of substantially cylindrically shaped yarn carrying cones carried by said cradles, each said cone having at least opposed portions of its outer surface conforming with the configuration of said opposed indentures forming said cradles;

a wedge member secured to the periphery of each said cone, said wedge being arranged perpendicular of the longitudinal axis of said cone and between said upper and lower surfaces, said wedge being operative to guide and deflect a moving yarn to slide over said upper and lower surfaces of said cone; and said cradle members engaging with said cones in a manner which allows said moving yarn to slip between said upper and lower surfaces of said cone and the associated indentured surface of said cradle member.

33. The apparatus of claim 32 wherein said indentured surfaces engage with said cones in a manner which prevents axial movement thereof.

34. The apparatus of claim 33 wherein each said cone includes a yarn guide formed in its forward end.

* * * * *